United States Patent [19]

Nolan

[11] Patent Number: 5,034,082

[45] Date of Patent: Jul. 23, 1991

[54] METHOD OF CONSTRUCTING A TENNIS RACKET

[75] Inventor: Dan Nolan, San Diego, Calif.

[73] Assignee: Prince Manufacturing, Inc., Lawrenceville, N.J.

[21] Appl. No.: 377,790

[22] Filed: Jul. 11, 1989

Related U.S. Application Data

[63] Continuation of Ser. No. 69,060, Jul. 2, 1987, abandoned.

[51] Int. Cl.[5] ..... B32B 31/04

[52] U.S. Cl. ..... 156/245; 156/293; 156/294; 273/73 F; 273/73 J; 273/73 R; 273/75

[58] Field of Search ..... 156/245, 293, 294; 273/67 R, 67 DA, 67 DB, 73 R, 73 F, 73 G, 73 J, 75, 73 C, 81 R, 81 B, 81 D, 193 B

[56] References Cited

U.S. PATENT DOCUMENTS

| | | | |
|---|---|---|---|
| 1,523,638 | 1/1925 | Freedlander et al. | 273/73 J |
| 1,563,780 | 12/1925 | Ovenshire | 273/73 J |
| 1,897,515 | 2/1933 | Hedstrom | 273/73 J |
| 3,072,955 | 1/1963 | Mitchell | 273/81 R |
| 3,189,069 | 6/1965 | Stowell | 273/81 R |
| 3,344,684 | 10/1967 | Steere et al. | 273/81 R |
| 3,547,440 | 12/1970 | Deer | 273/73 R |
| 3,638,943 | 12/1969 | Snaywaert | 273/73 J |
| 3,674,267 | 7/1972 | Hollis | 273/75 |
| 3,702,189 | 11/1972 | Galich | 273/73 J |
| 3,856,603 | 12/1974 | Schaefer et al. | 156/245 |
| 3,915,782 | 10/1975 | Davis et al. | 156/294 |
| 3,968,965 | 7/1976 | Frenkel et al. | 273/73 J |
| 4,007,929 | 2/1977 | Figa | 273/73 R |
| 4,052,060 | 10/1977 | Balkcom | 273/73 R |
| 4,077,627 | 3/1978 | Cheatham | 273/73 R |
| 4,506,887 | 3/1985 | Trysinsky | 273/73 F |
| 4,537,399 | 8/1985 | Adam | 273/75 |
| 4,848,746 | 7/1989 | Klink | 273/73 J |

FOREIGN PATENT DOCUMENTS

| | | | |
|---|---|---|---|
| 3101687 | 8/1982 | Fed. Rep. of Germany | 273/73 J |
| 3341256 | 5/1985 | Fed. Rep. of Germany | 273/73 J |
| 2540388 | 8/1984 | France . | |
| 0040378 | 10/1978 | Japan | 273/73 H |

*Primary Examiner*—Caleb Weston
*Attorney, Agent, or Firm*—White & Case

[57] ABSTRACT

A tennis racket includes a frame with a head and a shank portion. The shank portion has an outer periphery with top, bottom, side and diagonal outside surfaces arranged generally in an octagonal configuration. A preformed handle includes a core with a hollow interior having upper, lower, lateral and angled surfaces therein arranged to define generally an octagonal configuration. The surfaces in the interior of the core are sized to conform to the outside surfaces of the shank portion of the frame, and may include longitudinally extending flutes to reduce vibration, weight, and shock in the handle.

Handles of different grip sizes are preformed separate from the frames. The core elements are one piece, and may therefore be wrapped with leather or other gripping material and stored separate from the frames. When a finished racket frame is desired, adhesive is applied to the shank portion of the frame, and the handle slides over the end of the frame and seats on the outside surfaces. Because of the large contact area, the handle is mounted securely on the frame, and is structurally equivalent to rackets, in which the handle is built up individually on the racket.

9 Claims, 5 Drawing Sheets

METHOD OF CONSTRUCTING A TENNIS RACKET

This application is a continuation of application Ser. No. 069,060, filed July 2, 1987, now abandoned.

BACKGROUND OF THE INVENTION

The present invention is a tennis racket with a novel construction for mounting the handle.

Tennis racket frames include a head, which supports strings for hitting the ball, and a handle which is gripped by the player to impart the hitting stroke. The handle, which is mounted on a shank portion of the racket frame, customarily includes a core of wood, plastic, or other material wrapped by leather, and is octagonal in configuration so as to provide a comfortable gripping surface. Conventionally, the handle is constructed directly on the shank portion of the frame so that the handle and frame become, for structural purposes, a unitary member.

Tennis racket frames come in a variety of constructions, so as to offer a range of diversity in playing characteristics, e.g. in terms of stiffness and feel. Tennis players choose a racket depending upon their level of skill and personal preferences. In order to satisfy different players, manufacturers must offer a selection of racket models.

In addition to selecting a racket with the right playing characteristics, it is important that the handle be properly sized relative to the player's hand for comfort and a good grip. Since all tennis players do not have the same size hand, racket manufacturers must offer each model of racket in a range of grip sizes. As a practical matter, tennis pro shops and other sporting goods retailers (which normally sell more than one brand) need to stock a substantial inventory of tennis rackets of different models and grip sizes.

Deer U.S. Pat. No. 3,547,440 and Snauwaert U.S. Pat. No. 3,638,943 recognize the inventory problem that is created by having to stock tennis rackets in multiple grip sizes. Each of these patents proposes tennis rackets having handles which are provided with special mounting constructions so that the handles may slide onto the shank of the tennis racket frame and be attached by screws. Deer proposes brazing a spreader element and a stay, with a pair of threaded apertures, onto the end of the handle attachment portion of the frame. A plastic handle piece slides over the frame and abuts against the spreader element. A pair of holes are provided in the end of the plastic handle, which receive screws that extend into the threaded apertures of the stay element to hold the handle in place.

Snauwaert proposes a handle assembly that includes an eight-sided tube or sheath, a pair of ribs to secure the tube about the racket shank, and an end cap which is held in place by the tube. The upper end of the tube includes a pair of holes for receiving screws. A bore is provided through the racket shank, which receives a plastic plug at a location opposite the holes in the handle tube. The handle assembly slides over the shank 3 and screws are inserted through the holes in the tube and into the plastic plug to secure the handle in place.

Trysinsky U.S. Pat. No. 4,506,887 discloses another tennis racket handle assembly in which the handle is separate from the frame. As in the case of Deer and Snauwaert, Trysinsky proposes a rather complex construction for attaching the handle to the racket by screws. The assembly includes an inner core of rigid polyurethane and a piece of aircraft aluminum tubing bonded to the polyurethane and having four precisely drilled and bevelled holes. Outside handle covers, and a separate end cap, are placed over the polyurethane core. Screws extend through the core, through the holes in the aluminum tubing, and through holes formed in the racket shaft for attaching the handle.

Tennis rackets must be capable of withstanding considerable force upon impact of the ball. Furthermore, it is important to maintain solid contact between the racket frame and handle to avoid vibration. This is a principal reason for building the handle directly about the frame, i.e., so as to form a unitary structure. In order to achieve the same solid structure using a handle with a mechanical mounting structure and screws, as in the three proposals discussed above, it would be necessary to manufacture each of the pieces with great precision so as to produce a tight fit on the racket shank. This, along with the generally complex structure of these pieces, is undesirable from the standpoint of cost. Even if the handle could be solidly mounted on the racket shank initially, the repeated impact and vibration of striking the tennis ball might tend to loosen the handle from the frame at the stress bearing locations, e.g. the screws, over the life of the racket.

While the aforementioned patents recognize the desirability of a tennis racket with a separately mounted handle, all of these prior attempts have failed to provide a construction that is practical from a commercial and structural standpoint, and such constructions have not, to my knowledge, been adopted by any racket manufacturer. None of the patents therefore suggest a practical alternative to a handle formed individually on the racket, in terms of a preformed handle that can be separately mounted on the tennis racket frame and that structurally is comparable to a handle which is built up on the frame itself. For such reasons, tennis racket handles continue to be formed individually on the frame during construction of the racket, and the frame continues to be supplied from the manufacturer with a selected size grip already on the racket.

SUMMARY OF THE INVENTION

The present invention is a tennis racket with a novel construction for mounting the handle to the racket frame, which permits the handle to be formed separate from the racket frame proper, and in which the preformed handle may thereafter be mounted on the frame at any time producing a finished racket that has the integrity and strength of a racket in which the handle is individually formed on the frame. In accordance with the invention, the manufacturer may maintain separate stocks of rackets and handles, thus avoiding periodic shortages and overstocks of rackets due to unanticipated market demand. Alternatively, a manufacturer may supply rackets and handles, in different grip sizes, separately to retailers, where the racket is custom finished at the point of sale.

A racket according to the invention includes a frame with a head and a shank portion extending therefrom. The racket also includes a preformed handle. The shank portion of the frame has an outer periphery that is uniform along a length coextensive with the handle and with top, bottom, side, and diagonal outside surfaces arranged generally in an octagonal configuration.

The handle includes a core with a hollow interior. The hollow interior has upper, lower, lateral, and angled surfaces arranged to define a generally octagonal configuration, and sized to conform to the top, bottom, side, and diagonal outside surfaces of the frame.

In one embodiment, the top and bottom surfaces of the racket shank, which lie in planes parallel to the racket strings, include an inwardly extending groove. The upper and lower surfaces of the handle interior, which correspond to the top and bottom surfaces of the shank, include projections that extend into the groove of the respective top and bottom frame surfaces.

In another embodiment, the racket shank does not include a groove, and the core interior does not include projections. In the case of larger handle sizes, e.g. #3, #4, #5, and #6, the interior surfaces of the handle core may be fluted, that is, formed with longitudinally extending grooves. The flutes act to reduce vibration, weight, and shock in the racket handle. In the case of smaller handle sizes, e.g. #1 and #2, preferably solid cores (without flutes) are utilized.

The core of the preformed handle is preferably formed by injection molding, and is shaped to define a butt portion. The one piece core element is prewrapped with leather or other grip material in a manner similar to conventional rackets, the outer diameter of the core varying for different grip sizes. The handle and frame are assembled by sliding the handle over the outside surfaces of the frame, with adhesive being applied between the facing surfaces of the core and frame.

In a preferred embodiment of a racket according to the invention, the racket frame is formed from a fiber resin material, such as graphite. Graphite is wound to define a hollow tubular configuration, which is placed inside a heated mold. The mold conforms the tubular graphite into the shape of the racket, with opposite ends of the tube extending side-by-side to define the shank portion. Preferably, the mold, in the shank portion, is symmetrical about a center plane perpendicular to the plane of the racket head, such that the tubular element on either side of the symmetrical plane is shaped into a generally octagonal configuration, sharing an abutting wall.

For a better understanding of the invention, references is made to the following detailed description of preferred embodiments, taken in conjunction with the drawings accompanying the application.

DETAILED DESCRIPTION OF PREFERRED EMBODIMENTS

A tennis racket in accordance with the invention includes a frame 10 having a head portion 12 and a shank portion 14. A handle 16 slides over the shank portion 14 of the frame 10 for mounting thereon, as described further below.

The frame 10 is preferably formed of a tubular material, such as a resin-impregnated fiber material, e.g. graphite (carbon fiber-impregnated resin), which is molded into the shape of a tennis racket frame in a heated mold, in accordance with known processes.

Figure 2:
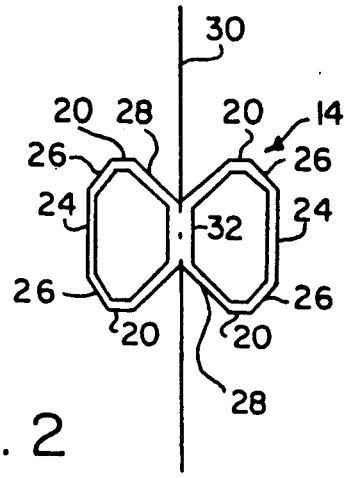
FIG. 2 is a cross-sectional view, taken through lines 2—2 of FIG. 1, showing the configuration of the shank portion of the frame.

Referring to FIG. 2, which shows the cross-sectional configuration of the shank portion 14 of the frame, the shank portion of the racket frame includes top 20, bottom 22, side 24, and diagonal 26 outside surfaces arranged generally in an octagonal configuration. The top and bottom surfaces 20, which lie in planes parallel to the head 12 of the racket 10, are formed with an inwardly extending, V-shape groove 28.

The shank portion 14 is symmetrical about a center plane 30 perpendicular to the plane of the racket head 12. Each half of the shank portion 14 has a generally octagonal configuration, sharing a common wall 32 along one of the sides. In this manner, the groove 28 in the top and bottom surfaces 20 is V-shaped. Each half is of hollow molded tubular construction.

Figure 1:
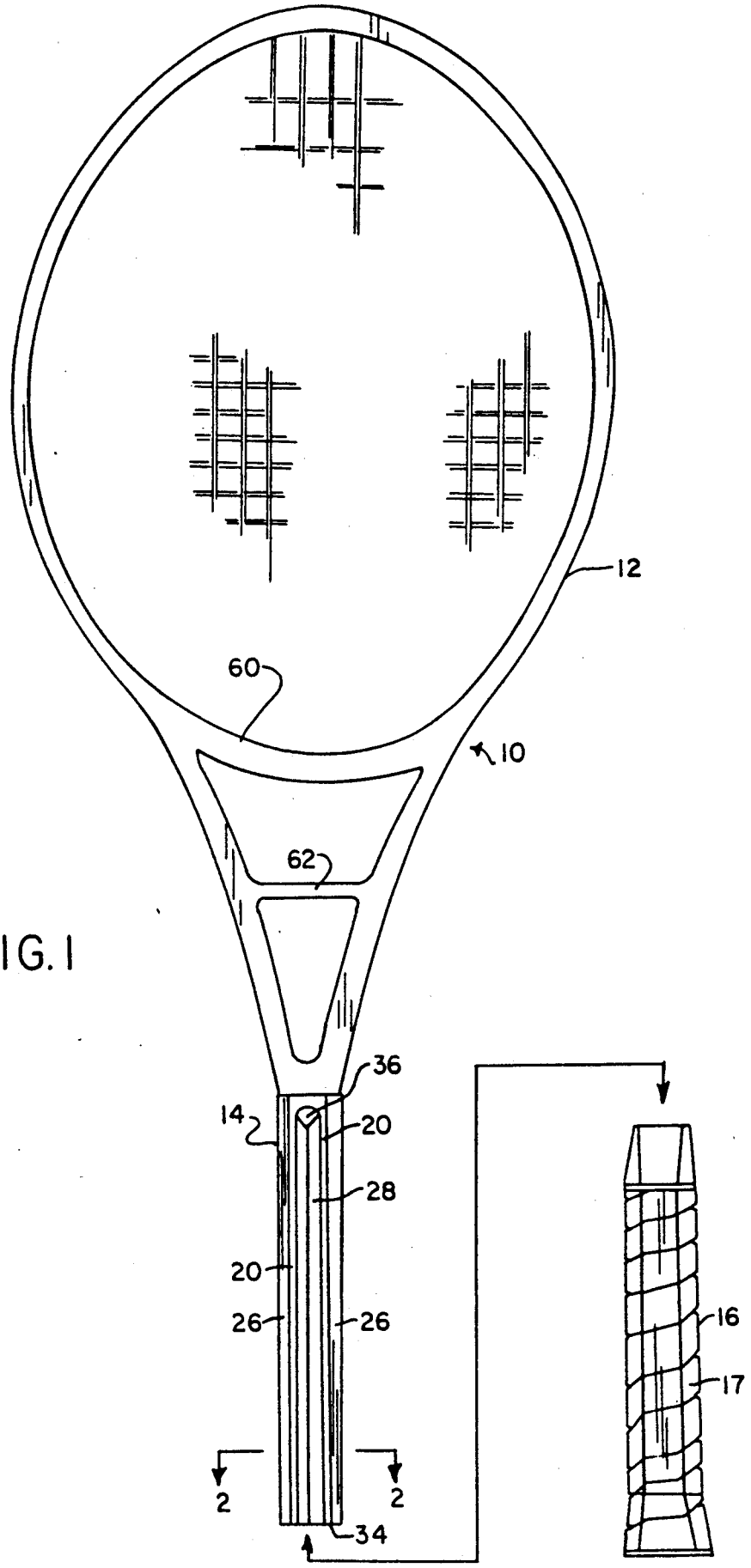
FIG. 1 is a top view of a tennis racket in accordance with the invention, shown prior to assembling the handle and frame.

Referring to FIG. 1, the groove 28 extends from the free end 34 of the shank portion 14 of the frame a distance which is coextensive with the length of the handle 16. The groove 28 terminates in an end wall 36. The shank portion 14 outer periphery is uniform along the length coextensive with the handle 16.

The handle 16 preferably is formed from a one piece core 40 of a rubber compound, polyurethane, or other material which is then wrapped with a grip material. Preferably, the core material is resilient to dampen vibration, reduce shock, and impart a solid feel to the racket. As shown in FIG. 1, the handle 16 may be wrapped in a helical fashion with leather gripping material 17, which overlies the core 40.

Figure 4:
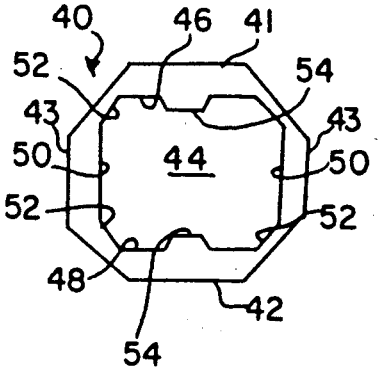
FIG. 4 is a sectional view, taken through lines 4—4 of FIG. 3, showing the core configuration of the handle.
Figure 3:
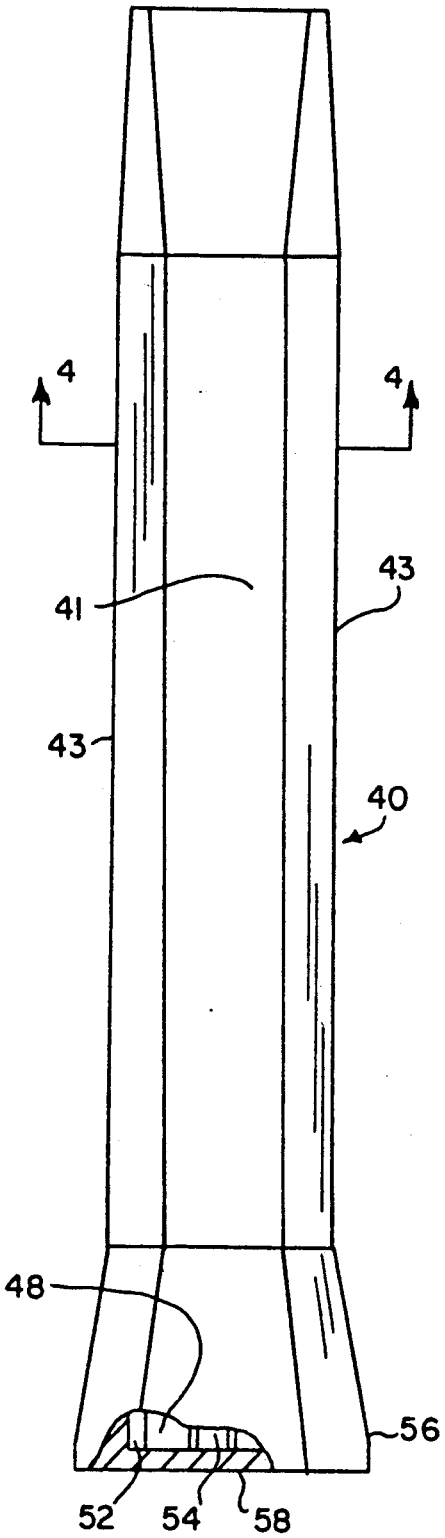
FIG. 3 is a top view of a first embodiment of a one piece core for forming a handle.

Referring particularly to FIGS. 3 and 4, the core 40 of the handle 16 is generally octagonal in configuration, although the top and bottom surfaces 41, 42 are somewhat wider than the side surface 43 for a more comfortable grip. The core 40 has a hollow interior 44 with upper 46, lower 48, lateral 50 and angled 52 inside surfaces which are arranged to define a generally octagonal configuration and which are sized to conform to the top and bottom 20, side 24, and diagonal 26 outer surfaces of the shank portion 14. Preferably, the width (distance between the lateral surfaces 50) is slightly greater than the height of the interior space, and the shank portion 14 is molded correspondingly so that the distance between the sides 24 is greater than the distance between top and bottom surfaces 20. The upper and lower surfaces 46 and 48 include inwardly extending projections 54 which are received in the grooves 28 when the handle 16 is mounted on the frame 10. As shown in FIG. 4, the sides of the projections 54 are bevelled to conform generally to the V-shaped surfaces of the groove shown in FIG. 2.

The hollow interior 44 of the core piece 40 is uniform along the length of the piece 40, so as to be able to slide onto the shank 14. The outside of the core 40 may be of uniform octagonal shape along its length thereof, or may be given other configurations as desired. Preferably, the core 40 is flared at the bottom end to define a butt portion 56, but once again other external configurations may be employed. If desired, the bottom 58 of the butt portion 56 may be closed, as shown in FIG. 3.

Because the interior 44 of the core piece 40 is uniform, the core piece may readily be formed as a one piece unit in a mold. By way of example, the mold is formed of an inner mold piece, uniform along its length and having the configuration of the space 44. A pair of outside mold members, which may be brought together to define the outside octagonal configuration of the core piece 40, including the butt portion 56 (or that define mold configurations other than as shown in FIG. 4), are positioned around the inside member, and polyurethane or other material is injected into the closed mold space. Thereafter, the outside mold members may be separated, and the inside mold member, defining space 44 may be withdrawn longitudinally from the hollow interior 44 of the core piece. Thus, a core piece 40 according to the invention is easy and economically feasible to manufacture as a one piece unit in mass production.

Preferably, the frame 10 is formed from a tubular graphite material in a process which is itself known. Strips of resin impregnated graphite fiber are first wound on a mandrel into a round tubular configuration. The strips are wound up at alternating angles so as to impart rigidity to the final product. An inflatable bladder is inserted into the hollow graphite tube, and the preformed lay-up is then placed in a mold having the general configuration of the frame shown in FIG. 1. A separate throat piece 60 and one or more cross pieces 62 may at this time be placed in the mold for joining to the main tubular element. When the mold closes, the bladder element is inflated to force the tubular member against the sides of the mold to conform the frame to the shape of the mold, and the mold is heated so as to cure the resinous material in the desired shape.

A frame in accordance with the invention is formed in a similar process, and producing the shaped handle portion 14 is a matter of adapting the shape of the mold in the shank portion 14 to define the external octagonal configuration. As can be appreciated, the core 40 can be molded to different outside dimensions corresponding to different size hand grips. Since the core is one piece, the gripping material may be wound up onto the core or otherwise applied in a manner similar to the application of existing grips. Thus, the final assembly 16, as shown in FIG. 1, is complete except for mounting on the racket. Cores of different exterior sizes are each provided with an interior 44 of a common size, so that any handle 16 will fit on any racket frame 10.

The frame 10 and handles 16 of different sizes may be separately maintained in inventory, and formed into a finished racket at such time as the manufacturer receives an order and ships the racket. Alternatively, it is possible to supply rackets 10 and handles 16 of different grip sizes to the retailer, to reduce the required inventory of rackets.

At such time as the handle 16 is to be mounted on the frame 10, adhesive such as contact adhesive (cyanoacrylate), double sided adhesive tape, or Loc-Tite #447 is applied to the outside surface of the handle portion 14 of the racket. Alternatively, double-backed tape with solvent (as used to mount golf club handle) may be used. The bottom end 34 of the frame 10 is then inserted into the open end of the handle 16, as shown in FIG. 1, and the handle 16 slides along the frame 14.

The handle 16 seats on the frame portion 14 at such point where the projections 54 engage the end wall 36 of the groove 28. Preferably, also, the end wall 58 of the core piece 40 at the same time abuts against the end wall 34.

In view of the large contact area between the surfaces 20, 22, 24, and 26 of the frame portion 14 and the inside surfaces 46, 48, 50, 52 and 54 of the core piece 40, good bonding between the pieces occurs, and the handle is mechanically supported in a secure manner on the frame as well. Thus, in the finished racket, the handle 16 is mounted as securely on the frame as in the case of known and presently used techniques for assembling the frame on the racket.

Figure 5:
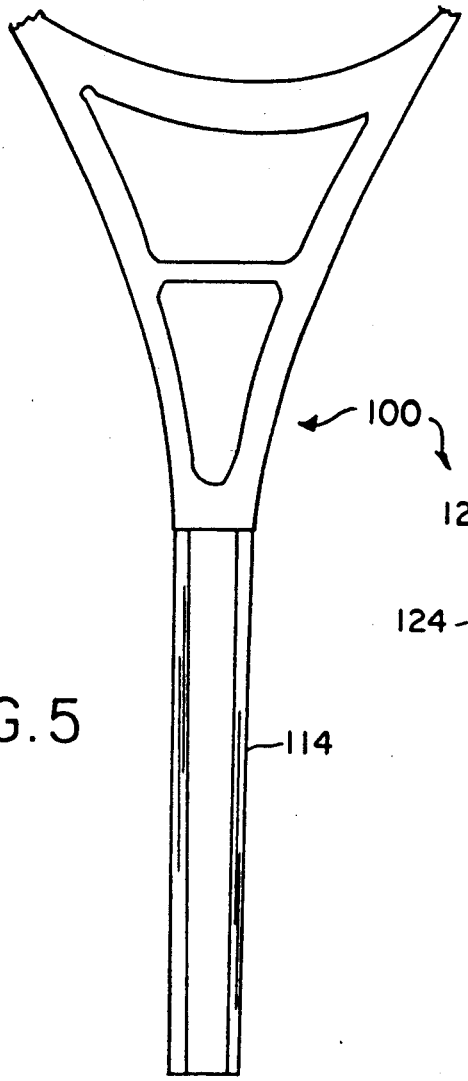
FIG. 5 is a top view of the handle portion of another embodiment of a racket frame.
Figure 6:
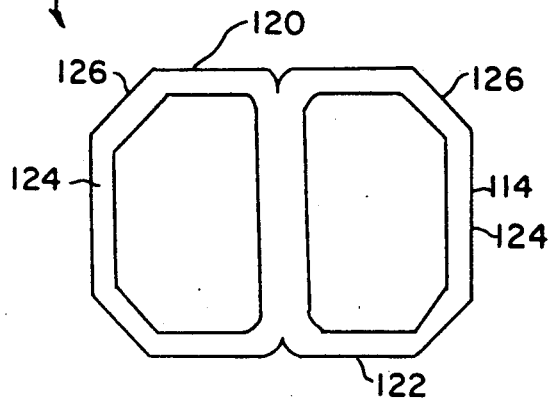
FIG. 6 is an end view of the handle portion shown in FIG. 5, on an enlarged scale.

FIGS. 5 and 6 illustrate another embodiment of a frame 100, wherein the shank portion 114 is formed to have an octagonal configuration but is essentially without the center grooves 28 of shank 14. Shank 114, as shown, has top 120, bottom 122, side 124 and diagonal 126 outside surfaces. Frame 100 is made in the same manner as frame 10, except that the mold members, in the shank portion, define the configuration of FIG. 6 rather than FIG. 2.

Figure 10:
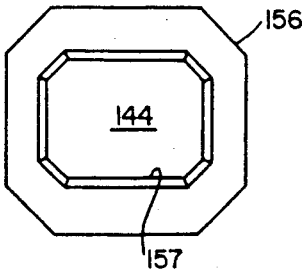
Figure 11:
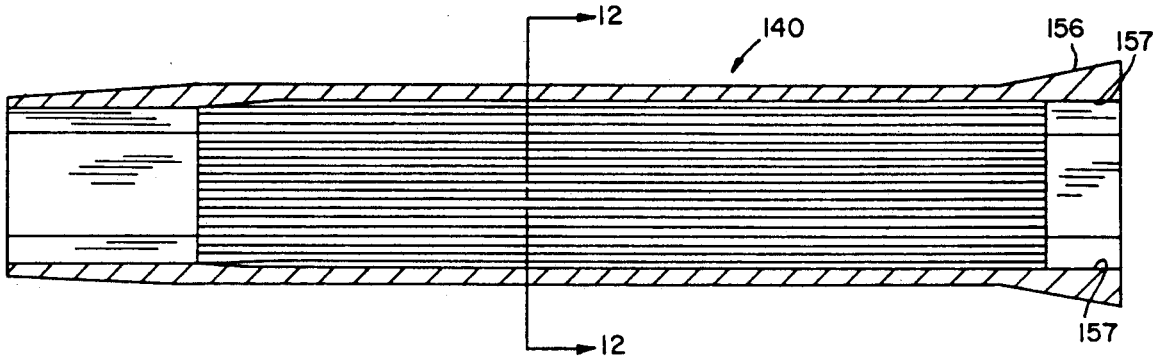
FIG. 11 is a longitudinal sectional view of the handle core shown in FIGS. 5–8.

FIGS. 7 through 12 illustrate an alternative embodiment of a core piece 140 that will fit preferably on frame 100, but will also fit on the frame 10. The core 140 has generally the same exterior octagonal configuration as core 40, that is, the top and bottom surfaces 141, 142 are slightly wider than the side surfaces 143. Core 140 also has an outwardly flared butt portion 156; however, the bottom is open. As shown in FIGS. 10 and 11, the interior wall surfaces 157 in the open end of the butt portion taper inwardly slightly toward one another, and as a result the butt portion 156 can readily receive an end plug (not shown) with complementary bevelled side walls. As in the case of core piece 40, the outside surfaces in the forward end 159 of the core 140 taper inwardly toward edge 161, but the inside dimensions within space 144 remain uniform.

Figure 12:
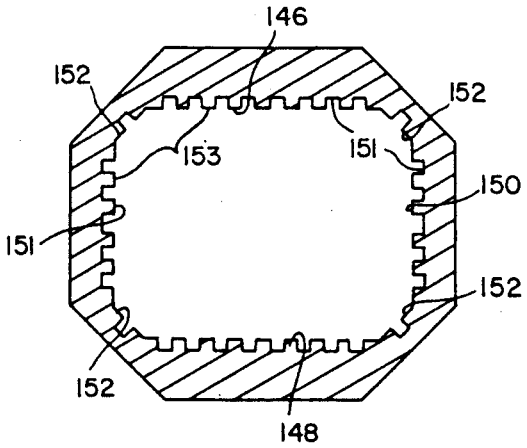
FIG. 12 is a cross-sectional view of the handle core, taken through lines 10—10 of FIG. 5.

FIGS. 11 and 12 illustrate the internal configuration of core piece 140, which includes upper 146, lower 148, lateral 150, and angled 152 inside surfaces arranged in a generally octagonal configuration. As shown, the width between opposing side surfaces 150 is slightly greater than the distance between upper and lower surfaces 146, 148, and as noted before the racket shank 14 is molded so that the sides 24 and top and bottom surfaces 20 define an octagon in which the width is correspondingly greater than the height.

As shown, the surfaces 146, 148, 150 and 152 are fluted, that is, include longitudinally extending grooves 151, to provide a series of spaced contact surfaces 153. Core 140 slides onto the racket shank 14 in a manner similar to core 40, such that the upper and lower surfaces 146, 148 engage the top and bottom surfaces 20 of the shank 14, lateral surfaces 150 engage the sides 24 of the shank 14, and angled surfaces 152 engage diagonal surfaces 26 of the shank 14.

Figure 13:
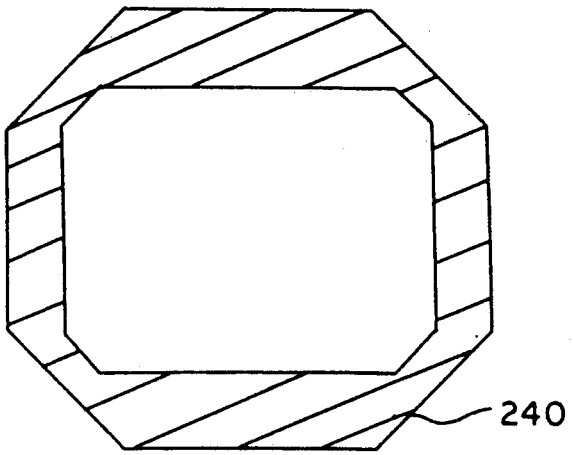
FIG. 13 is a cross-sectional view, similar to FIG. 12 but of another embodiment of a handle core.
Figure 7:
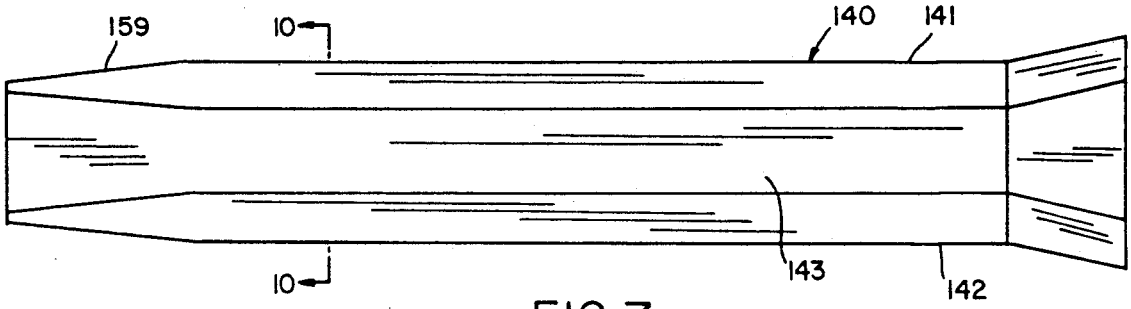
FIGS. 7 through 10 are side, top, front and back views, respectively, of another embodiment of a racket handle core according to the invention.
Figure 8:
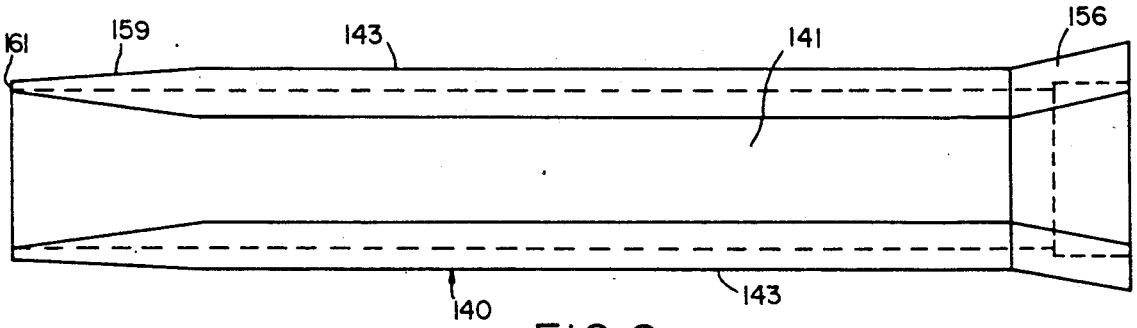
Figure 9:
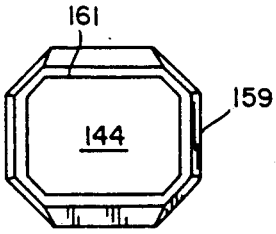

The FIG. 13 core piece 240 is the same as core piece 140, except that the inside diagonal surfaces do not employ flutes. This configuration is preferred for smaller size racket handles, e.g. #1 and #2, whereas the fluted configuration is preferred for larger handle sizes, e.g. #3 and larger.

As in the case of FIGS. 2–5, the embodiment of FIGS. 8–12 and of FIG. 13 provides snug contact between the core 140 and shank 114 over a large surface area, so that the pieces can be firmly bonded to one another, and the assembly is mechanically resistant to loosening. At the same time, the flutes 151, 153 act to reduce vibration, weight, and shock in the handle. As in the case of core 40, core 140 can readily and economically be molded as a one piece unit ready for receiving a grip, and cores of different sizes, wrapped to form handles, can be stored separate from the racket frame.

The invention may be utilized with frame materials other than graphite. However, in view of the fact that the shank portion 14 of the frame and core interior are to be given complementary shapes, the present invention is contemplated for use preferably with fiber resin materials or other plastic materials which may be molded to a predetermined shape in the shank portion 14.

The foregoing represents the preferred embodiments according to the invention. Variations and modifications of the embodiments described herein will be apparent to persons skilled in the art, without departing from the inventive concepts disclosed herein. All such modifications and variations are intended to be within the scope of the invention, as set forth in the following claims.

I claim:

1. A method of constructing a tennis racket comprising the steps of:

(a) forming a frame with a head and a shank portion extending axially therefrom, wherein the shank portion has a distal end and outside surfaces defining an outside periphery which is generally uniform along a length extending from said distal end;

(b) molding a one piece, tubular handle core having longitudinally opposite ends, at least one of said ends being open, said core having an elongated, hollow interior extending from said open end at least substantially to the opposite end and sized to frictionally engage the outside periphery of said shank portion, said core being constructed to slide longitudinally on and off the shank without mechanical engagement;

(c) applying an adhesive to the outside surfaces of the frame shank portion;

(d) permanently mounting the core on the frame by sliding the frame shank portion into the hollow interior of the core so as to extend from the open end at least substantially to the opposite end; and (e) wrapping a grip material about the outside surfaces of the core to form an outside covering for the same.

2. A method as defined in claim 1, wherein the shank portion has top, bottom, side, and diagonal outside surfaces arranged generally in an octagonal configuration, and wherein the core interior has upper, lower, lateral and angled surfaces conforming to the outside surfaces of the frame.

3. A method according to claim 1, wherein said core is made of a resilient material.

4. A method as defined in claim 1, comprising further the step of molding a plurality of cores of different outside dimensions, corresponding to different grip sizes, wherein the interiors of said cores have the same dimensions, and the step of selecting, from among different size cores, a core corresponding to the desired grip size for mounting on the frame.

5. A method according to claim 4, wherein said core are made of resilient material.

6. A method according to claim 5, wherein the grip material is wrapped in helical fashion about the core material.

7. A method of constructing a tennis racket comprising the steps of:

(a) providing a frame having a head and a shank portion extending axially therefrom, wherein the shank portion has a distal end and an outside periphery defined by generally planar outside surfaces, said periphery being uniform along a length extending from said distal end;

(b) molding a one piece, tubular handle core, of a rubber compound, having longitudinally opposite ends, at least one of which is open, said core having an elongated, hollow interior extending from said open end at least substantially to the opposite end and having surfaces sized to frictionally engage the planar outside surfaces of said shank portion, said core being constructed to slide longitudinally on and off the shank without mechanical engagement;

(c) applying an adhesive to the outside surfaces of the frame shank portion;

(d) permanently mounting the core on the frame by sliding the frame shank portion into the hollow interior of the core so as to extend from the open end at least substantially to the opposite end; and (e) wrapping a grip material about the outside surfaces of the core to form an outside covering for the same.

8. A method according to claim 7, comprising further the step of molding a plurality of cores of different outside dimensions, corresponding to different grip sizes, wherein the interiors of said cores have the same dimensions, and the step of selecting, from among the different size cores, a core corresponding to the desired grip size for mounting on the frame.

9. A method according to claim 7, wherein the grip material is wrapped in helical fashion about the core material.

* * * * *